United States Patent [19]

Nelson, Jr.

[11] 4,280,622

[45] Jul. 28, 1981

[54] TAPERED INSERT

[75] Inventor: Bennie C. Nelson, Jr., Romeoville, Ill.

[73] Assignee: Container Corporation of America, Chicago, Ill.

[21] Appl. No.: 102,741

[22] Filed: Dec. 12, 1979

[51] Int. Cl.[3] ..... B65D 5/50; B65D 81/00; B65D 85/30

[52] U.S. Cl. ..... 206/592; 206/577

[58] Field of Search ..... 206/592, 594, 521, 45.19, 206/315 B, 577; 229/35

[56] References Cited

U.S. PATENT DOCUMENTS

| | | | |
|---|---|---|---|
| 1,156,074 | 10/1915 | Hahn | 206/594 |
| 2,570,946 | 10/1951 | Hennessey | 206/592 |
| 2,979,250 | 4/1961 | Hobbs | 229/32 |
| 3,123,204 | 3/1964 | Baker et al. | 206/45.19 |

*Primary Examiner*—William T. Dixson, Jr.

*Attorney, Agent, or Firm*—Richard W. Carpenter; Davis Chin

[57] ABSTRACT

A tapered packing insert having an integral self-locking corner construction.

2 Claims, 5 Drawing Figures

TAPERED INSERT

SUMMARY OF THE INVENTION

This invention relates to internal supports or packing inserts for use in holding a packaged article in place within an outer container.

It is an object of the invention to provide a tapered packing insert formed from a unitary blank of foldable sheet material such as paperboard.

A more specific object of the invention is the provision of an insert having an integral self-locking corner construction arrangement which does not require the use of external securing means such as adhesive, staples, or tapes.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DRAWINGS

Figure 2:
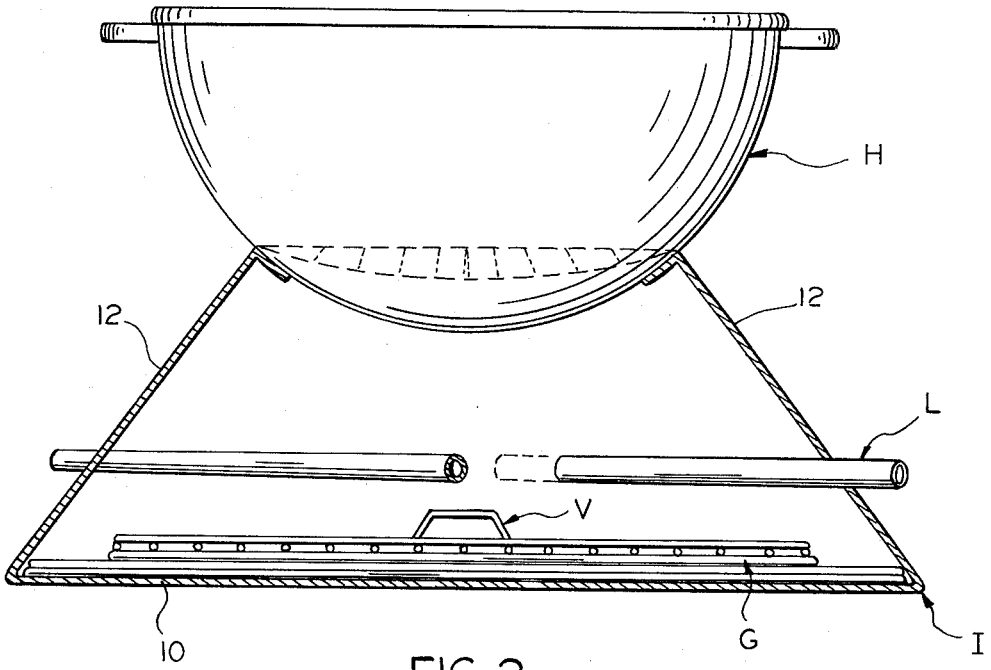
FIG. 2 is an enlarged view, partly in vertical section, of a portion of the structure illustrated in FIG. 1.
Figure 1:
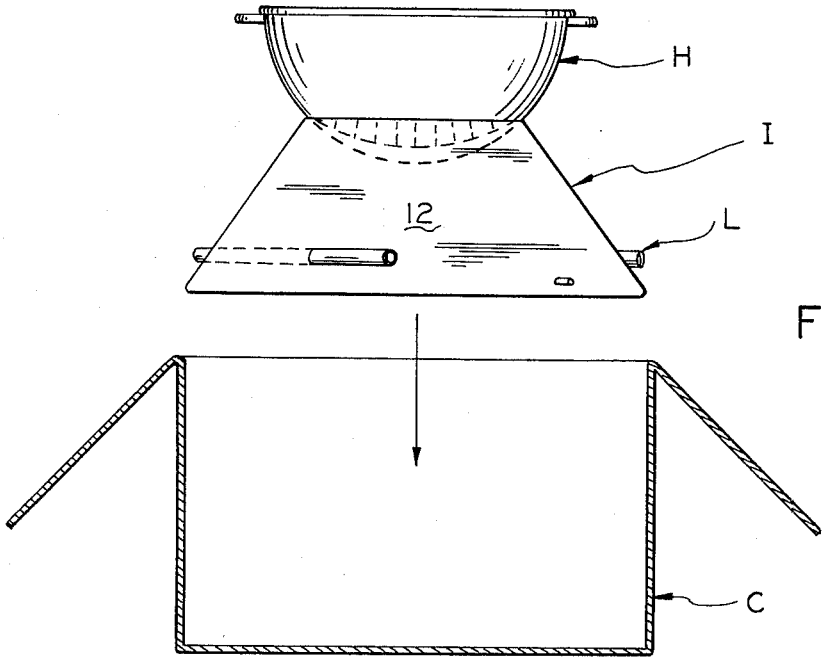
FIG. 1 is an exploded side elevation of an outer container and a packing insert, holding a packaged article, embodying features of the invention.
Figure 4:
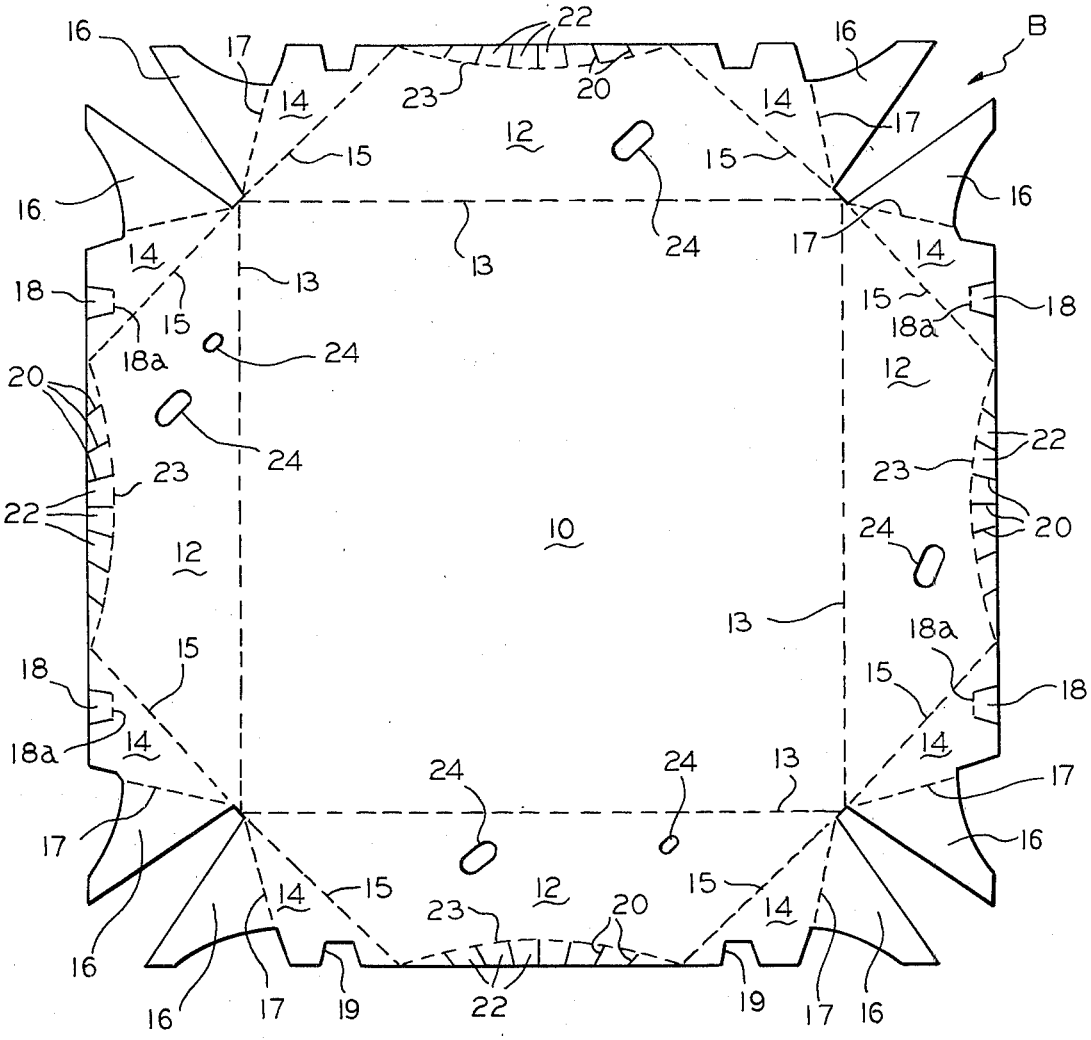
FIG. 4 is a plan view of a blank of material from which the structure illustrated in the other views may be formed.

Referring now to the drawings for a better understanding of the invention and particularly to FIGS. 1 and 2, it will be seen that the invention comprises a tapered insert, indicated generally at I, which may be formed from a unitary blank B of foldable paperboard illustrated in FIG. 4.

Insert I is adapted to be received within an outer container, indicated generally at C, and to hold therein a packaged article. Although the insert may be used to hold various types of articles for illustrative purposes, in FIGS. 1 and 2 the insert I is shown as holding a spherically shaped outdoor cooking grill housing indicated generally at H, together with the grill G, and a plurality of legs L.

The essential novelty in the invention resides in the interlocking corner structure of the insert which is described in greater detail later herein, and such corner construction is suitable for tapered inserts of use for varying purposes.

Figure 5:
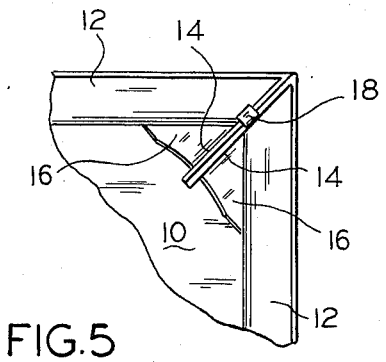
FIG. 5 is a perspective view of the corner structure arrangement of the insert illustrated in the other views.
Figure 3:
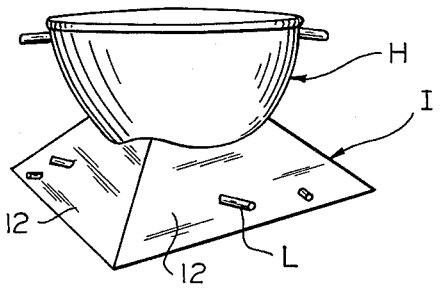
FIG. 3 is a perspective view of the structure of FIG. 2.

As best seen in FIGS. 4 and 5, insert I includes a preferably rectangular bottom wall 10 having pairs of opposed side walls 12 foldably joined at their lower edges along fold lines 13 to opposed side edges of bottom wall 10 and extending upwardly and inwardly therefrom to provide a generally frusto-pyramidal shaped structure.

The structural arrangement at each of the corners includes integral means for joining the ends of adjacent side walls in interlocking arrangement without requiring any outside securing means such as staples, adhesives or tapes. Each corner construction includes a pair of generally triangular first corner flanges 14 foldably joined along corresponding upper edges on diagonal fold lines 15 to related end edges of adjacent side walls 12 and a pair of generally triangular second corner flanges 16 foldably joined along corresponding side edges on fold lines 17 to the lower edges of respective first corner flanges 14. When the structure is in erected condition as shown in FIG. 5, it will be seen that each pair of first flanges is disposed to extend downwardly from side walls 12 toward the bottom wall in face-to-face relation with each other, while second flanges 16 are disposed to extend outwardly at right angles from the lower edges of the respective first flanges and to lie on the upper surface on the bottom wall in face-to-face relation therewith.

It will be seen that at least one of each pair of first flanges 14 is provided with a lock tab 18 foldably joined thereto on a fold line 18*a*, with the lock tab 18 being folded into interlocking engagement with a complementary recess 19 provided in the other first flange 14 to connect adjacent side walls of the insert to each other.

In order to facilitate the insertion of the spherically shaped housing H into the upper portion of the insert, the side walls 12 may be provided with a plurality of parallel inwardly extending cut lines 20 which provide a plurality of cushioning tabs 22 foldably joined to upper portions of side walls 12 on arcuate fold lines 23 and adapted to flex in order to accommodate positioning of the housing.

The side walls 12 of the container may be provided with a plurality of holes 24 to accommodate positioning of the legs L as shown in FIG. 2. The space in the insert below the housing may also be used to contain the grill G and cover V of the container which can rest on the bottom wall 10 as shown in FIG. 2.

I claim:

1. A tapered packing insert, for holding an article within an outer container, formed a unitary blank of foldable paperboard and comprising:

(a) a generally rectangular bottom wall;

(b) pairs of opposed side walls foldably joined at their lower edges to and extending upwardly and inwardly from adjacent side edges of said bottom wall;

(c) integral corner locking means interconnecting ends of adjacent side walls, including:

(i) a pair of generally triangular first corner flanges foldably joined at their upper edges to end edges of respective side walls and extending downwardly therefrom toward said bottom wall in face-to-face relation with each other;

(ii) a pair of generally triangular second corner flanges foldably joined at corresponding side edges to lower edges of respective first corner flanges and extending outwardly therefrom toward related side walls in face-to-face relation with said bottom wall;

(iii) at least one locking tab foldably joined to one of said first flanges and received within a complementary slot in the other of said first corner flanges.

2. An insert according to claim 1, wherein said side walls have upper marginal portions each of which includes a plurality of upwardly projecting flexible cushioning flanges separated from each other by cut lines and foldably joined to the related side wall on fold lines which are aligned segments of a curved fold line to accommodate seating thereof of an article having a generally spherical bottom.

* * * * *